US009719739B2

(12) United States Patent
Windauer

(10) Patent No.: US 9,719,739 B2
(45) Date of Patent: Aug. 1, 2017

(54) GAS BLOCK BALANCING PISTON FOR AUTO-LOADING FIREARM

(71) Applicant: Bernard (Bernie) T. Windauer, Kalispell, MI (US)

(72) Inventor: Bernard T. Windauer, Kalispell, MT (US)

( * ) Notice: Subject to any disclaimer, the term of this patent is extended or adjusted under 35 U.S.C. 154(b) by 0 days.

(21) Appl. No.: 14/615,167

(22) Filed: Feb. 5, 2015

(65) Prior Publication Data

US 2016/0161200 A1 Jun. 9, 2016

Related U.S. Application Data

(60) Provisional application No. 61/936,519, filed on Feb. 6, 2014.

(51) Int. Cl.
*F41A 5/28* (2006.01)

(52) U.S. Cl.
CPC ..... *F41A 5/28* (2013.01)

(58) Field of Classification Search
CPC ..... F41A 5/18; F41A 5/20; F41A 5/22; F41A 5/24; F41A 5/26; F41A 5/28
USPC ..... 89/191.01, 191.02, 192, 193
See application file for complete search history.

(56) References Cited

U.S. PATENT DOCUMENTS

| | | | |
|---|---|---|---|
| 454,403 | A | 6/1891 | Odkolek |
| 729,143 | A | 5/1903 | Reifgraber |
| 1,138,377 | A | 5/1915 | Hammond |
| 1,333,498 | A | 3/1920 | Lang |
| 1,350,961 | A | 8/1920 | Farquhar et al. |
| 1,366,863 | A | 1/1921 | Berthier |
| 1,382,058 | A | 6/1921 | Bourdelles |
| 1,388,879 | A | 8/1921 | Nelson |
| 1,431,057 | A | 10/1922 | Sutter |
| 1,738,501 | A | 12/1929 | Moore |
| 1,808,052 | A | 6/1931 | McCann |
| 2,003,066 | A | 5/1935 | Brondby |

(Continued)

FOREIGN PATENT DOCUMENTS

| | | |
|---|---|---|
| BE | 332360 | 3/1926 |
| BE | 586850 | 2/1960 |

(Continued)

OTHER PUBLICATIONS

PCT/US2010/022293, International Search Report and Written Opinion, Oct. 26, 2011, 9 pages.

*Primary Examiner* — Jonathan C Weber
(74) *Attorney, Agent, or Firm* — Parsons Behle & Latimer

(57) ABSTRACT

A gas block assembly for a firearm comprises a cylinder chamber fluidly coupled to the bore of a barrel of the firearm through a gas inlet port. A spool-type balancing piston is disposed for reciprocation within the cylinder chamber between gas transmitting and bypass positions. A spring stack acts on the balancing piston to bias same toward the gas transmitting position. The gas cylinder receives a gas pressure from the barrel when a projectile is fired. When the pressure exceeds a predetermined threshold, the gas block assembly vents the excess gas pressure either into the barrel of the firearm or to atmosphere or into an associated sound suppressor. The balancing piston is designed with a counter-balance chamber. Gas pressure routed into the counter-balance chamber works in conjunction with the spring stack to urge the balancing piston toward its gas transmitting position.

11 Claims, 11 Drawing Sheets

(56) References Cited

U.S. PATENT DOCUMENTS

| | | | | |
|---|---|---|---|---|
| 2,058,897 | A | 10/1936 | Marek | |
| 2,340,293 | A | 2/1944 | Balleisen | |
| 2,369,669 | A | 2/1945 | Garand | |
| 2,457,835 | A | 1/1949 | Schiff | |
| 2,462,119 | A | 2/1949 | Moore | |
| 2,554,618 | A | 5/1951 | Dixon | |
| 2,685,754 | A | 8/1954 | Crittendon et al. | |
| 2,715,858 | A | 8/1955 | Hoppert | |
| 2,748,662 | A | 6/1956 | Simpson | |
| 2,750,849 | A | 6/1956 | Harvey | |
| 2,777,366 | A * | 1/1957 | Cook | F41A 5/26 89/191.01 |
| 2,783,685 | A | 3/1957 | Green | |
| 2,791,944 | A | 5/1957 | Harvey | |
| 2,814,972 | A | 12/1957 | Simmons, Jr. | |
| 2,845,008 | A | 7/1958 | Atwood, Jr. | |
| 2,870,685 | A | 1/1959 | Harvey | |
| 2,872,851 | A | 2/1959 | Katz | |
| 2,895,383 | A | 7/1959 | Reed | |
| 2,909,101 | A | 10/1959 | Hillberg | |
| 2,918,848 | A | 12/1959 | Maillard | |
| 2,935,915 | A | 5/1960 | Janson | |
| 2,951,424 | A | 9/1960 | Stoner | |
| 2,987,968 | A | 6/1961 | Janson | |
| 3,020,807 | A | 2/1962 | Hailston et al. | |
| 3,024,706 | A | 3/1962 | Wild | |
| 3,036,501 | A | 5/1962 | Wild | |
| 3,127,812 | A | 4/1964 | Into et al. | |
| 3,246,567 | A | 4/1966 | Miller | |
| 3,261,264 | A | 7/1966 | Wilson | |
| 3,323,418 | A | 6/1967 | Loffler | |
| 3,330,183 | A | 7/1967 | Loffler | |
| 3,333,509 | A | 8/1967 | Muhlemann | |
| 3,359,860 | A | 12/1967 | Muhlemann | |
| 3,420,140 | A | 1/1969 | Beretta | |
| 3,443,477 | A | 5/1969 | Kaempf | |
| 3,592,101 | A | 7/1971 | Vartanian et al. | |
| 3,680,434 | A | 8/1972 | Muhlemann | |
| 3,690,219 | A | 9/1972 | Muhlemann et al. | |
| 3,707,110 | A | 12/1972 | Alday | |
| 3,709,092 | A | 1/1973 | Tazome | |
| 3,779,131 | A | 12/1973 | Kawamura | |
| 3,795,173 | A | 3/1974 | Freymond | |
| 3,810,412 | A | 5/1974 | Zamacola | |
| 3,893,370 | A | 7/1975 | Hutton et al. | |
| 3,945,296 | A | 3/1976 | Hyytinen | |
| 3,968,727 | A | 7/1976 | Hyytinen | |
| 3,982,468 | A | 9/1976 | Browning | |
| 3,988,964 | A | 11/1976 | Moore | |
| 3,990,348 | A | 11/1976 | Vesamaa | |
| 4,019,423 | A | 4/1977 | Johnson | |
| 4,102,243 | A | 7/1978 | Jennie | |
| 4,126,077 | A | 11/1978 | Quesnel | |
| 4,174,654 | A | 11/1979 | Liedke | |
| 4,244,273 | A | 1/1981 | Langendorfer et al. | |
| 4,279,191 | A | 7/1981 | Johansson | |
| 4,373,423 | A | 2/1983 | Moore | |
| 4,414,880 | A | 11/1983 | Throner | |
| 4,418,608 | A | 12/1983 | Klumpp | |
| 4,599,934 | A | 7/1986 | Palmer | |
| 4,611,525 | A | 9/1986 | Bosshard et al. | |
| 4,693,170 | A | 9/1987 | Atchisson | |
| 4,702,146 | A | 10/1987 | Ikeda et al. | |
| 4,798,124 | A | 1/1989 | Hurlemann et al. | |
| 4,872,392 | A | 10/1989 | Powers et al. | |
| 4,901,623 | A | 2/1990 | Lee | |
| 5,218,163 | A | 6/1993 | Dabrowski | |
| 5,272,956 | A | 12/1993 | Hudson | |
| 5,404,790 | A | 4/1995 | Averbukh | |
| 5,429,034 | A | 7/1995 | Badali et al. | |
| 5,726,377 | A | 3/1998 | Harris et al. | |
| 5,824,943 | A | 10/1998 | Guhring et al. | |
| 5,831,202 | A | 11/1998 | Rustick | |
| 5,945,626 | A | 8/1999 | Robbins | |
| 6,374,720 | B1 | 4/2002 | Tedde | |
| 6,382,073 | B1 | 5/2002 | Beretta | |
| 6,516,700 | B1 | 2/2003 | Nikonov et al. | |
| 6,606,934 | B1 | 8/2003 | Rock et al. | |
| 6,622,610 | B2 | 9/2003 | Adkins | |
| 6,868,770 | B2 | 3/2005 | Cornils | |
| 7,213,498 | B1 | 5/2007 | Davies | |
| 7,467,581 | B2 | 12/2008 | Botty | |
| 7,469,624 | B1 | 12/2008 | Adams | |
| 7,594,465 | B2 | 9/2009 | Borgwarth et al. | |
| 7,610,843 | B2 | 11/2009 | Beretta | |
| 7,610,844 | B2 | 11/2009 | Kuczynko et al. | |
| 7,621,210 | B2 | 11/2009 | Fluhr et al. | |
| 7,637,199 | B2 | 12/2009 | Fluhr et al. | |
| 7,739,939 | B2 | 6/2010 | Adams | |
| 7,775,150 | B2 | 8/2010 | Hochstrate et al. | |
| 7,779,743 | B2 | 8/2010 | Herring | |
| 7,810,423 | B2 | 10/2010 | Monroe | |
| 7,827,722 | B1 | 11/2010 | Davies | |
| 7,832,326 | B1 | 11/2010 | Barrett | |
| 7,856,917 | B2 | 12/2010 | Noveske | |
| 7,891,284 | B1 | 2/2011 | Barrett | |
| 7,921,760 | B2 | 4/2011 | Tankersley | |
| 7,934,447 | B2 | 5/2011 | Kuczynko et al. | |
| 7,938,055 | B2 | 5/2011 | Hochstrate et al. | |
| 7,946,214 | B2 | 5/2011 | Stone | |
| 7,963,203 | B1 | 6/2011 | Davies | |
| 8,528,458 | B2 * | 9/2013 | Windauer | F41A 5/26 89/193 |
| 2002/0053280 | A1 | 5/2002 | Tedde | |
| 2004/0237766 | A1 | 12/2004 | Cornils | |
| 2005/0262752 | A1 | 12/2005 | Robinson et al. | |
| 2006/0065112 | A1 | 3/2006 | Kuczynko et al. | |
| 2006/0236582 | A1 | 10/2006 | Lewis et al. | |
| 2007/0199435 | A1 | 8/2007 | Hochstrate et al. | |
| 2008/0276797 | A1 | 11/2008 | Leitner-Wise | |
| 2008/0307954 | A1 | 12/2008 | Fluhr et al. | |
| 2009/0000173 | A1 | 1/2009 | Robinson et al. | |
| 2009/0007478 | A1 | 1/2009 | Fluhr et al. | |
| 2009/0223357 | A1 | 9/2009 | Herring | |
| 2009/0229454 | A1 | 9/2009 | Fluhr et al. | |
| 2010/0024636 | A1 | 2/2010 | Winge | |
| 2010/0095834 | A1 | 4/2010 | Kuczynko et al. | |
| 2010/0199836 | A1 | 8/2010 | Herring | |
| 2010/0224056 | A1 | 9/2010 | Monroe | |
| 2010/0236396 | A1 | 9/2010 | Stone | |
| 2010/0275769 | A1 | 11/2010 | Brittingham | |
| 2010/0275770 | A1 | 11/2010 | Noveske | |
| 2010/0282066 | A1 | 11/2010 | Tankersley | |
| 2010/0319528 | A1 | 12/2010 | Kenney et al. | |
| 2011/0023699 | A1 | 2/2011 | Barrett | |
| 2011/0023700 | A1 | 2/2011 | Herring | |
| 2012/0167756 | A1 | 7/2012 | LaRue | |
| 2013/0025445 | A1 * | 1/2013 | Windauer | F41A 5/28 89/193 |

FOREIGN PATENT DOCUMENTS

| | | |
|---|---|---|
| BE | 1015572 | 6/2005 |
| CA | 2597441 A1 | 7/2006 |
| CA | 2705534 A1 | 5/2009 |
| CH | 29709 | 12/1903 |
| CH | 50723 | 9/1909 |
| CH | 90978 | 9/1920 |
| CH | 101634 | 3/1922 |
| CH | 147188 | 5/1931 |
| CH | 481362 | 12/1969 |
| CH | 631542 | 8/1982 |
| DE | 597634 | 5/1934 |
| DE | 609372 | 2/1935 |
| DE | 648391 | 7/1937 |
| DE | 712087 | 10/1941 |
| DE | 1453904 A1 | 9/1969 |
| DE | 2302785 B2 | 1/1976 |
| DE | 2702679 A1 | 2/1978 |
| DE | 2834332 | 8/1979 |
| DE | 2932710 A1 | 3/1981 |
| DE | 69412384 | 3/1999 |
| DE | 19615181 C2 | 2/2001 |
| DE | 10318828 A1 | 11/2004 |

(56) References Cited

FOREIGN PATENT DOCUMENTS

| | | | |
|---|---|---|---|
| EP | 0114204 | A2 | 8/1984 |
| EP | 0167067 | B1 | 12/1987 |
| EP | 0380041 | A1 | 8/1990 |
| EP | 1052470 | A2 | 11/2000 |
| EP | 1471325 | B1 | 9/2006 |
| ES | 257018 | | 10/1981 |
| ES | 2336031 | | 9/2008 |
| FR | 17062 | | 6/1913 |
| FR | 22353 | | 7/1921 |
| FR | 563468 | | 12/1923 |
| FR | 747501 | | 6/1933 |
| FR | 763021 | | 4/1934 |
| FR | 1155066 | | 4/1958 |
| FR | 1235856 | | 5/1960 |
| FR | 1450319 | | 7/1966 |
| FR | 2369533 | | 5/1978 |
| FR | 2532741 | | 3/1984 |
| FR | 2805341 | | 8/2001 |
| FR | 2866700 | | 8/2005 |
| GB | 19000202 | | 8/1910 |
| GB | 191014385 | | 4/1911 |
| GB | 191300373 | | 3/1913 |
| GB | 191501589 | | 7/1915 |
| GB | 393195 | | 6/1933 |
| GB | 472469 | | 9/1937 |
| GB | 474685 | | 11/1937 |
| GB | 604116 | | 6/1948 |
| GB | 608354 | | 9/1948 |
| GB | 615019 | | 12/1948 |
| GB | 1055817 | | 1/1967 |
| GB | 1128112 | | 9/1968 |
| GB | 1120303 | | 10/1968 |
| GB | 1582091 | | 12/1980 |
| JP | S57127797 | | 8/1982 |
| JP | S6124999 | | 2/1986 |
| RU | 2164334 | | 3/2001 |
| RU | 2237839 | | 10/2004 |
| WO | 03098144 | A1 | 11/2003 |
| WO | 2005121686 | A2 | 12/2005 |
| WO | 2008014984 | A1 | 2/2008 |
| WO | 2008108786 | A2 | 9/2008 |

* cited by examiner

GAS BLOCK BALANCING PISTON FOR AUTO-LOADING FIREARM

CROSS REFERENCE TO RELATED APPLICATIONS

This application claims priority to Provisional Patent Application No. 61/936,519 filed Feb. 6, 2014, the entire disclosure of which is hereby incorporated by reference and relied upon.

BACKGROUND OF THE INVENTION

Field of the Invention

The invention relates generally to firearms with gas ports, and more particularly to a pressure-regulating gas block for an auto-loading firearm.

Description of Related Art

Military and tactical operations require various ammunition types and various types of semi-automatic and fully automatic firearms. The firearms are also used in both normal and silenced modes of operation. The various types of ammunition develop a wide range of gas pressures when the gunpowder burns. When silencers (sound suppressors) are used, they create a back pressure within the operating system of the firearm. The ambient temperatures in which the firearms are used also create a variation in the pressures within the firearm as the firearm is operated. Given all the conditions that cause variations in the pressures within the firearm, there are a seemingly infinite number of pressure variations that can occur. When a firearm is designed, the average working conditions are determined in view of expected variations in pressure within the firearm and stresses and construction material strengths calculated.

Military-grade firearms have three modes of fire: Semi-automatic, Automatic, and Burst. When a firearm is used in a semi-automatic mode without a silencer or in an automatic mode without a silencer, the speed of operation (cyclic rate) of the firearm is not usually a factor considered to affect a soldier's safety although the sound signature is considered to be a significant factor that adversely affect a soldier's safety due to alerting the enemy to the soldier's position. When a firearm is used in the semi-automatic mode with a silencer, the cyclic rate of the firearm operation is not considered to be a significant factor that adversely affects the soldier's safety because the firearm only fires once per trigger squeeze, however, the sound signature could be a critical (i.e., life and death) factor depending on the ambient conditions. When a firearm is used in the fully-automatic mode with a silencer, the cyclic rate of the firearm operation and the sound signature could be a critical (i.e., life and death) factor to the soldier's safety depending on ambient conditions. A problem that has existed since the advent of gas-operated firearms that are used with silencers has been the increase in cyclic rate due to the increased backpressure created by the silencer installed on the end of the barrel. The cyclic rate increase due to the additional back pressure adds additional stresses to the firearm beyond the designed average working conditions causing material failures and ammunition-loading failures as well as an increased sound signature, both of which may compromise the safety of a soldier using the firearm.

Another problem that exists is the increase in cyclic rate of the firearm used in the semi-automatic and fully-automatic modes, which occurs when the ammunition type changes for a given firearm. Different ammunition types develop different operating pressures. Firearm operating temperatures based on duration of operation and ambient temperatures also affect operating temperatures. A difference in operating pressure above the pressure for which the firearm was designed increases in cyclic rate of the firearm, which causes excessive stresses on the operating parts of the firearm, and may cause breakage of the operating parts and/or ammunition-loading failures. The problems caused by greater-than-design pressures and/or increase in cyclic rate and sound signature (when used with a silencer) can result in creating a life and death situation for a soldier and/or the soldier's team members.

The Pressure Regulating Gas Block (PRGB) disclosed in U.S. Pat. No. 8,528,458 gathers gas pressure from the burning propellant propelling the projectile down the barrel and regulates the pressure passing through the gas block prior to diverting it to the operating system of the firearm. The entire disclosure of U.S. Pat. No. 8,528,458 is hereby incorporated by reference and relied upon. In one embodiment, the operating piston moves rearward to seal off the incoming gas port and open up a port to relieve the gas pressure back into the barrel after the bullet has passed by the port. In another embodiment, the gas pressure from the incoming gas port pushes rearward on the operating piston moving the piston rearward. As the operating piston moves a certain distance rearward gas is allowed to flow forward and push forward on a relief piston. The relief piston is held rearward by a compression spring against the incoming gas pressure. When the force of the gas pressure distributed over the surface area of the relief piston exceeds the force of the compression spring, the relief piston moves forward thus relieving pressure through relief vents to atmosphere or back into the barrel (after the bullet has passed by).

While U.S. Pat. No. 8,528,458 presents a substantial and compelling improvement in the art, from an engineering/manufacturability perspective it can be challenging and/or expensive to provide a spring for this application that is of an acceptable size to be used in firearms applications and yet also possesses a compression force that will not be overcome by the incoming gas pressure as applied over the surface area of the piston. Larger springs with greater compression force can be used but their size exceeds the acceptable size to be used on a firearm.

There is therefore a need for an improved gas block balancing system that can regulate pressure in a compact size with a minimum of parts.

BRIEF SUMMARY OF THE INVENTION

According to one aspect of this invention, a gas block balancing assembly is provided for an auto-loading firearm. The assembly comprises a housing having forward and rearward ends. The housing is configured for attachment to a rifle barrel that has a first gas port. A cylinder chamber is disposed within the housing. The housing includes an inlet port extending from the cylinder chamber and disposed to receive pressurized gas from the first gas port of the barrel. The housing also includes an outlet port extending from the cylinder chamber. A gas tube receptacle is disposed in the housing. The gas tube receptacle is configured to couple with a gas tube conduit. An adjustment plug is disposed in the cylinder chamber. The adjustment plug has a nipple portion that extends into the cylinder chamber generally along the cylinder axis. A balancing piston is located in the cylinder chamber for axial sliding movement between a gas transmitting position and a bypass position. The balancing piston has a first end disposed adjacent the end wall of the cylinder and an opposite second end disposed adjacent the adjustment plug. A biasing member is operatively disposed between the adjustment plug and the balancing piston for urging the balancing piston toward the gas transmitting position. A counter-balance chamber extends into the second end of the balancing piston. The counter-balance chamber comprises a generally cylindrical bore disposed generally along the cylinder axis. The counter-balance chamber has an internal diameter that is configured to mate with the nipple of the adjustment plug in close-fitting sliding engagement.

According to another aspect of this invention, an auto-loading firearm assembly is provided. The firearm assembly includes an elongated barrel adapted to direct the path of a projectile propelled by an expanding build-up of gas pressure along a bore axis thereof. A first gas port extends radially through the barrel. A gas block balancing assembly is operatively associated with the barrel. The gas block balancing assembly includes:

a) a housing having forward and rearward ends. The housing is configured for attachment to the barrel. A cylinder chamber is disposed within the housing. The housing includes an inlet port that extends from the cylinder chamber and disposed to receive pressurized gas from the first gas port of the barrel. The housing also includes an outlet port that extends from the cylinder chamber. A gas tube receptacle is disposed in the housing. The gas tube receptacle is configured to couple with a gas tube conduit.

b) an adjustment plug disposed in the cylinder chamber. The adjustment plug has a nipple portion that extends into the cylinder chamber generally along the cylinder axis.

c) a balancing piston in the cylinder chamber disposed for axial sliding movement between a gas transmitting position and a bypass position. The balancing piston has a first end adjacent the end wall of the cylinder and an opposite second end adjacent the adjustment plug. A counter-balance chamber extends into the second end of the balancing piston. The counter-balance chamber comprises a generally cylindrical bore disposed generally along the cylinder axis. The counter-balance chamber has an internal diameter configured to mate with the nipple of the adjustment plug in close-fitting sliding engagement. And, d) a biasing member operatively disposed between the adjustment plug and the balancing piston for urging the balancing piston toward the gas transmitting position.

The present invention offers an improved gas block balancing system that can regulate pressure in a compact size with a minimum of parts. The balancing piston is configured so that pressures generated within its counter-balance chamber act in concert with the biasing member to enable a reduction in the size of the biasing member. As a result, a compact size biasing member can be used to handle the relatively high pressures of gas operated firearms. After a projectile is fired, incoming gas is directed at equal pressure to both ends of the balancing piston. Gas pressure applied over the first end of the balancing piston creates a forward-acting (axial) force, whereas gas pressure applied to the balancing piston from inside its counter-balance chamber creates a rearward-acting (axial) force. The rearward acting force created by the pressure applied through the counter-balance chamber has the effect of reducing, or diminishing the forward acting force. This reduced or diminished forward acting force allows a smaller spring force for the biasing member to be used to retard the forward movement of the balancing piston when the incoming gas pressure exceeds a pre-set limit. The combined axial force of the biasing member and the rearward acting force created by the gas pressure within the counter-balance chamber counteracts the forward acting force of the gas pressure applied to the first end of the balancing piston.

BRIEF DESCRIPTION OF THE SEVERAL VIEWS OF THE DRAWINGS

These and other features and advantages of the present invention will become more readily appreciated when considered in connection with the following detailed description and appended drawings, wherein.

DETAILED DESCRIPTION OF THE INVENTION

Figure 1:
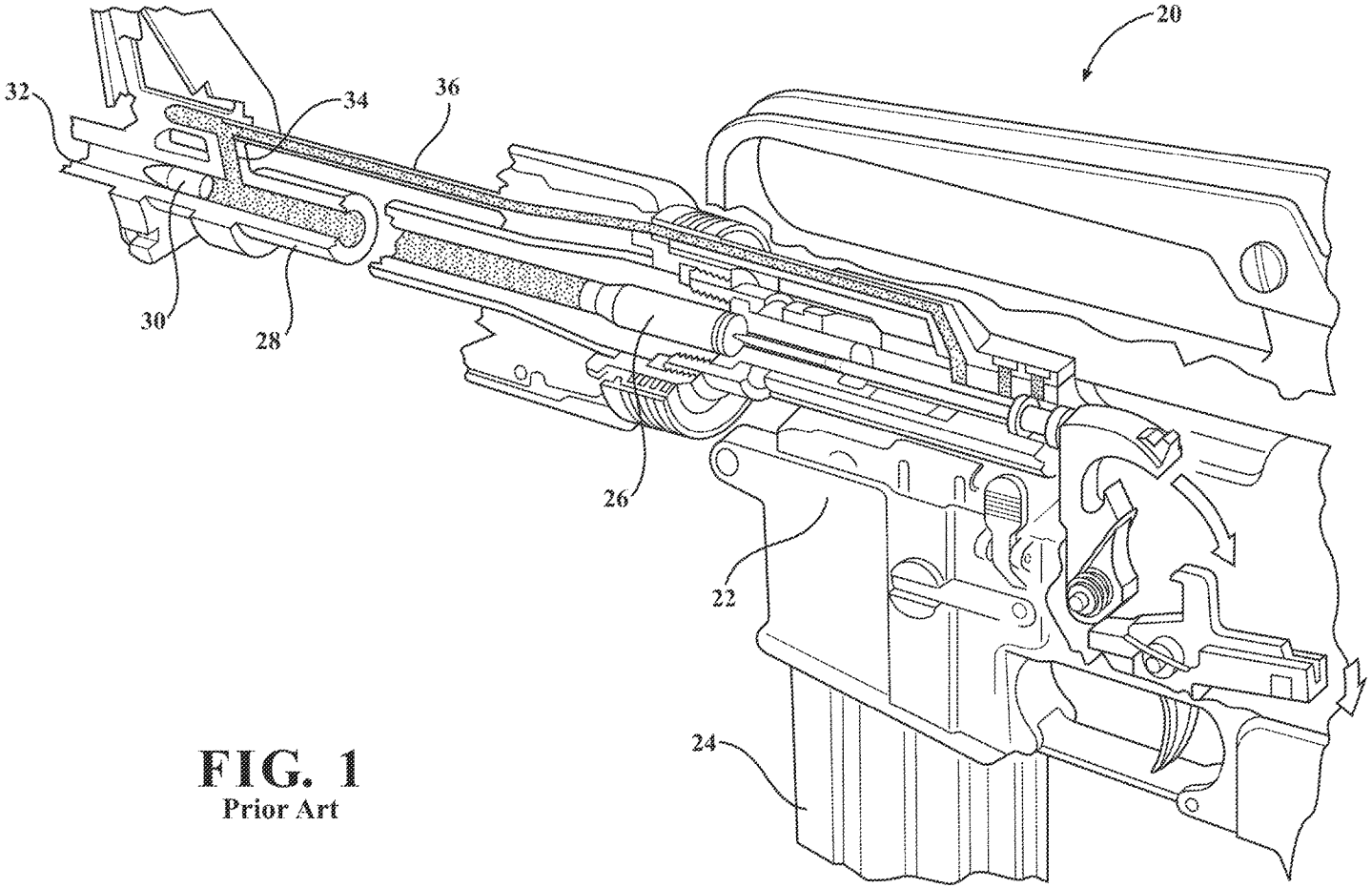
FIG. 1 Prior Art
FIG. 1 is a highly schematic, partially sectioned view of an AR-style firearm illustrating by way of example the prior art method of direct gas impingement to energize the auto-loading action.

Referring to the figures, wherein like numerals indicate like or corresponding parts throughout the several views, an example of an auto-loading firearm is generally shown at 20 in FIG. 1. The firearm is shown here in the iconic AR platform, however the principles of this invention are directly transferable to other platform types. Being well-known, the illustrated AR platform provides a convenient contextual example upon with the present gas block balancing assembly may be applied. The firearm 20 is shown including a receiver 22 into which an ammunition magazine 24 is fitted. A bolt carrier group, hammer assembly and trigger group are arranged within the receiver 22 so as to strike the primer of an ammunition round that is chambered in the breach end of a barrel 28 at the will of a user.

The barrel 28 is elongated and adapted to direct the path of a projectile 30 along a bore axis thereof, as propelled by an expanding build-up of gas pressure from the burning gunpowder contained in the cartridge portion 26 of the ammunition round. Opposite the breech end of the barrel 28 is a muzzle 32. As with most modern auto-loading firearms, the AR platform uses a portion of the gas pressure from the burning gunpowder to cycle the bolt carrier group which is described in summary fashion in the next paragraph. The gas pressure is tapped from a gas port 34 that extends radially through the barrel 28 adjacent its muzzle 32.

The firing cycle of a typical auto-loading firearm is described briefly in order to provide context for an exemplary embodiment of this invention. After a loaded magazine 24 has been inserted into the receiver 22, eight cycles of functioning may be described as: Firing, Unlocking, Extracting, Ejecting, Cocking, Feeding, Chambering and Locking. With a round in the chamber, the hammer cocked, and the selector on SEMI, the user squeezes the trigger. A hammer spring drives the hammer forward, striking the head of a firing pin and driving the firing pin into the primer of the round. The primer ignites, causing the powder in the cartridge to ignite. The gas generated by the rapid burning of the powder forces the projectile 30 from the cartridge 26 and propels it through the barrel 28. After the projectile 30 has passed the gas port 34 (located on the upper surface of the barrel 28 under the front sight) and before it leaves the barrel 28, gas enters the gas port 34 and moves into a gas tube 36. The gas tube 36 directs the gas back to the bolt carrier. Gas pressure passes down through a key and into a space between the rear of the carrier's bolt cavity and the rear of the bolt itself. Then, the gas expands. The bolt is locked into the barrel extension, unable to move forward; the carrier is forced to the rear by the expanding gas. As the bolt carrier moves to the rear, the extractor (which is attached to the bolt) grips the rim of the cartridge case 26, and withdraws the cartridge case 26 from the chamber. The spent cartridge 26 is pushed out by the action of an ejector and ejector spring. The rearward movement of the bolt carrier overrides the hammer. The hammer is forced down into the receiver, and the hammer spring is compressed. This action cocks the hammer in the firing position. When the bolt carrier group clears the top of the magazine 24, a new round is pushed up into the path of the forward movement of the bolt. The buffer assembly and bolt carrier group are then pushed forward by an action spring with enough force to strip a new round from the magazine 24. As the bolt carrier group moves forward, the bolt thrusts the new round into the chamber and locks in place ready to repeat the firing cycle.

As stated above in the Background section, a pressure regulating gas block such as that disclosed in U.S. Pat. No. 8,528,458 can be beneficial to regulate the pressure diverted it to the action of the firearm in order to assure that the correct amount of force is applied. The pressure regulating gas block of U.S. Pat. No. 8,528,458 utilizes compression spring acting against an internal piston to control the pressure at which relief or bypass occurs. However, given the often high operating pressures, e.g., on the order of 19,000 psi, it can be challenging and/or expensive to provide a suitable spring that is of small enough size. The present invention represents an improvement pressure regulating gas block system that is capable of regulating pressure yet in a compact size and with a minimum of parts.

Turning now to FIGS. 2-7, one embodiment of the present invention is depicted in the form of a gas block balancing assembly, generally shown at 38. The gas block balancing assembly 38 is shown operatively associated with a barrel 28 for an auto-loading firearm. The gas block balancing assembly 20 is shown in these figures fitted near the muzzle 32 of the barrel 28. However it will be appreciated that the exact location of the assembly 38 along the length of the barrel 28 may vary from one application to the next. It may, for example, be determined that an installation nearer the midpoint of the barrel 28 may be preferred. Therefore, those of skill in the art will understand that the illustrations are merely informative and should be appreciated as not limited the invention is certain non-essential details.

In this particular embodiment, the barrel 28 is formed with a first gas port 40 and a second gas port 42. The second gas port 42 disposed longitudinally between the first gas port and the muzzle. Both ports 40, 42 extend radially through the barrel 28, however the first gas port 40 is oriented generally perpendicular to the bore axis whereas the second gas port 42 is oriented at an oblique angle relative to the bore axis. The oblique angle of the second gas port 42 is preferably pitched away from the muzzle 32. As will be described subsequently, the second gas port 42 may be configured differently.

The gas block balancing assembly 38 includes a housing, generally indicated at 44. The housing 44 has forward 46 and rearward 48 ends, corresponding to the pointing direction of the firearm to which it is attached. That is to say, the forward end 46 of the housing 44 is proximate the muzzle 32 whereas the rearward end 48 is closer to receiver 22. The housing 44 may be disposed in direct surface-to-surface contact with the outer surface of the barrel 28.

A cylinder chamber 50 is formed within the housing 44. The cylinder chamber 50 defines a cylinder axis A that, at least in the illustrated examples, is generally parallel to the bore axis of the barrel 28. The cylinder chamber 50 extends from the forward end 46 of the housing 44 to an end wall 52 within the housing 44. The end wall 52 may be described as adjacent the rearward end 48 of the housing, however it is perhaps more accurately stated that the end wall 52 is positioned somewhere between the rearward end 48 and the mid-length point of the housing 44. Of course, other designs implementing this invention may vary the terminating position of the end wall 52 within the housing 44 to more favorably suit a particular application. The cylinder chamber 50 is perhaps best shown in the enlarged views of FIGS. 6 and 7 including female thread forms 54 adjacent the open end thereof.

An inlet port 56 extends from the cylinder chamber 50 and is disposed in fluid communication with the first gas port 40 of the barrel 28. The housing 44 also includes an outlet port that extends from the cylinder chamber 50 and is disposed in fluid communication with the second gas port 44 of the barrel 28. A reservoir chamber 60 is formed inside the housing 44. The reservoir chamber 60 is in fluid communication with the end wall 52 of the cylinder chamber 50 so that gas pressure moves freely there between. The housing 44 further includes a gas tube receptacle 62 that is configured to couple with a gas tube conduit 36 of the type used to energize the auto-loading action of a direct gas impingement style firearm like that described above in connection with FIG. 1. A transfer port 64 fluidly connects the reservoir chamber 60 and the gas tube receptacle 62.

An adjustment plug, generally indicated at 66, is disposed in the cylinder chamber 50 for the purpose of closing its open end, i.e., the end of the cylinder chamber 50 opposite the end wall 52. The adjustment plug 66 has a fixture portion 68 and a nipple portion 70. The nipple portion 70 comprises a generally cylindrical projection that extends into the cylinder chamber 50 generally along the cylinder axis A. The fixture portion 68, on the other hand, comprises external thread forms that are adapted to engage the female thread forms 54 in the one end of the cylinder chamber 50. When the adjustment plug 66 is threaded into the cylinder chamber 50, a fluid tight seal is established. The adjustment plug 66 includes a tool receiving portion 72. The tool receiving portion 72 is shown in the form of a hex-socket adapted to receive the working end of an Allen wrench, however other options exist including but not limited to wrenching flats, screw-driver slots, knobs for hand-turning, and the like.

Figure 4:
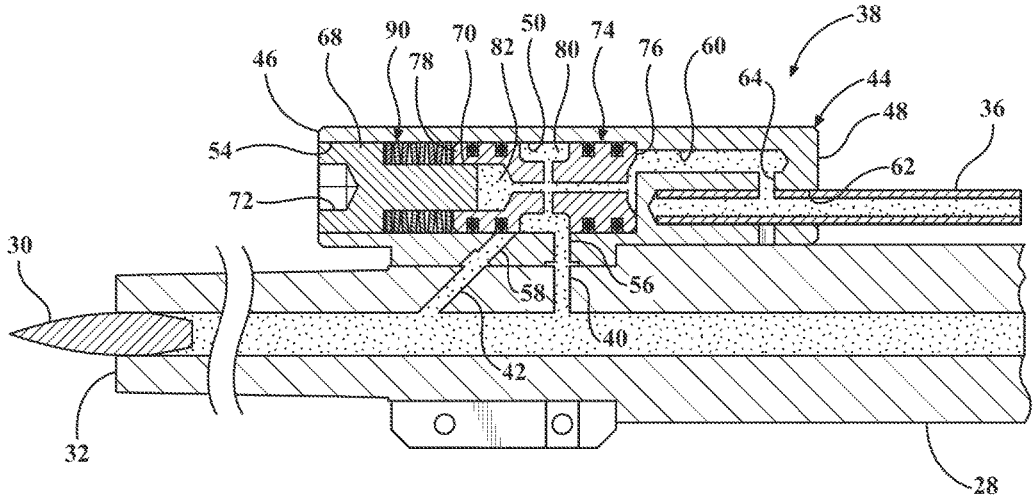
FIG. 4 is a view as in FIG. 3 showing the bullet further advanced along the barrel at the moment before exit from the muzzle, with the trailing build-up of gas pressure remaining below the predetermined maximum pressure threshold.
Figure 5:
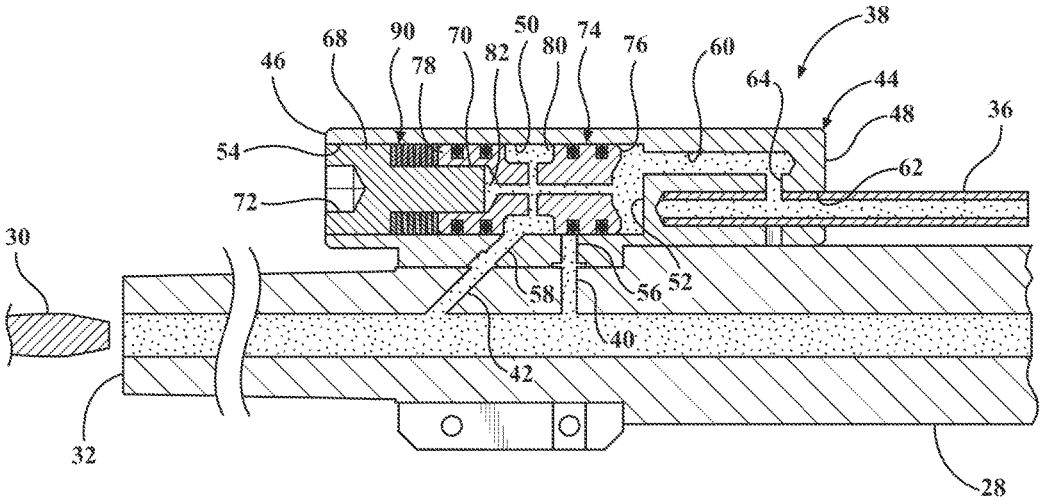
FIG. 5 is a view as in FIG. 4 but showing the alternative condition where the trailing build-up of gas pressure exceeds the predetermined maximum pressure threshold.
Figure 6:
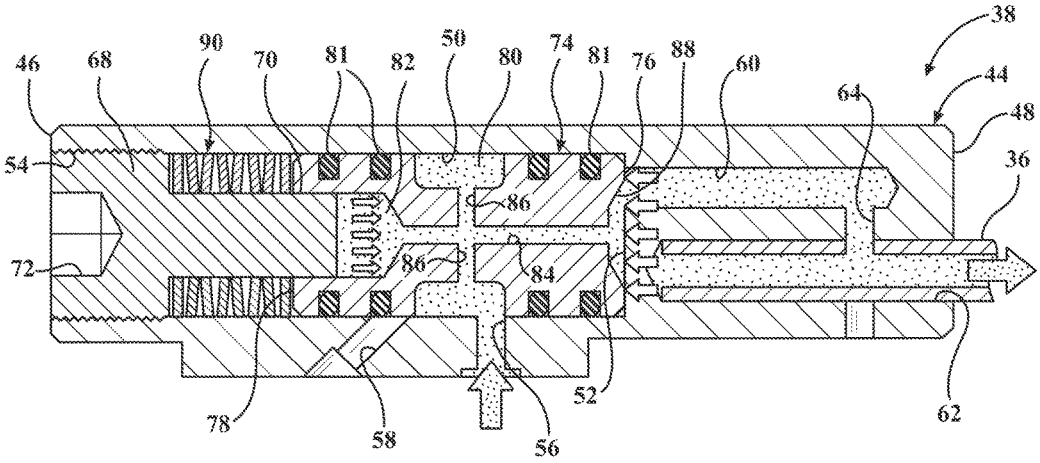
FIG. 6 is an enlarged view of the gas block balancing assembly in situations where the gas pressure is below the predetermined maximum pressure threshold as in FIGS. 3 and 4.
Figure 7:
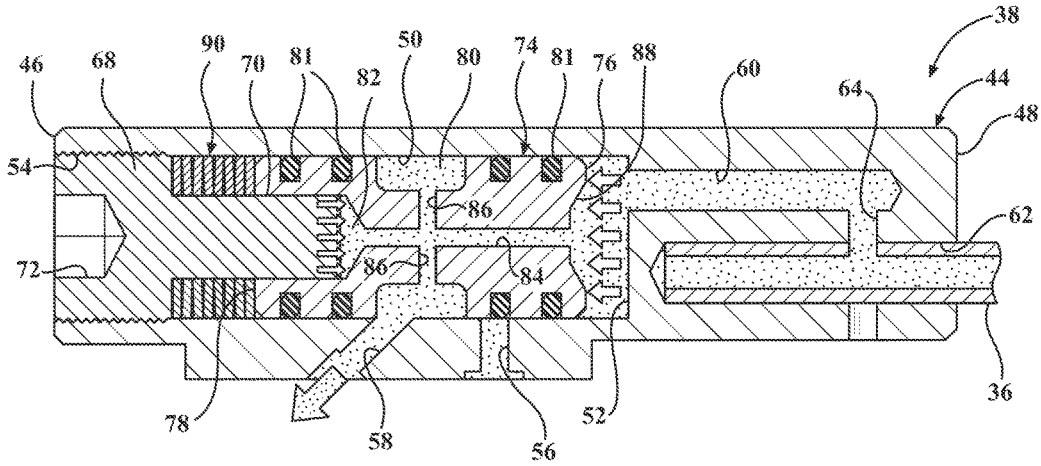
FIG. 7 is an enlarged view of the gas block balancing assembly in situations where the gas pressure exceeds the predetermined maximum pressure threshold as in FIG. 5.

A balancing piston, generally indicated at 74, is disposed in the cylinder chamber 50 with an engineered fit for smooth axial sliding movement between a gas transmitting position (FIGS. 2-4 and 6) and a bypass position (FIGS. 5 and 7). As will be described in detail below, in the gas transmitting position the balancing piston is pressed tight against the end wall 52. And in the bypass position, the balancing piston is shifted a specified distance away from the end wall 52.

The balancing piston 74 illustrated in this example comprises a generally cylindrical body having a first end 76 disposed adjacent the end wall 52 of the cylinder and an opposite second end 78 disposed adjacent the adjustment plug 66. In some ways, the balancing piston 74 may be compared to a spool valve in that it shuttles back and forth in response to changes in the force differential at its opposite ends 76, 78. An external gas collection groove 80 is formed in the balancing piston 74. The gas collection groove 80 may take many different forms, but in the depicted example comprises a generally annular exterior surface formation which, as will be seen, allows the balancing piston 74 to freely rotate (about the cylinder axis A) within the cylinder chamber 50 without affecting its functionality. The gas collection groove 80 is positioned along the body of the balancing piston 74 so that it is in fluid communication with the inlet port 56 of the housing 44 when the balancing piston 74 is in the gas transmitting position, as shown in FIGS. 2-4 and 6. However, when the balancing piston 74 is in the bypass position (FIGS. 5 and 7), the gas collection groove 80 is shifted into fluid communication with the outlet port 58 of the housing 44.

The balancing piston 74 includes at least one external sealing element 81 disposed between the gas collection groove 80 and its first end 76, and at least one external sealing element 81 disposed between the gas collection groove 80 and its second end 78. The figures suggest that the sealing elements 81 are O-ring type features, however in practice these may be rectangular steel piston rings or possibly Labyrinth seals.

The balancing piston 74 is formed with a counter-balance chamber 82 extending into its second end 78 like a counterbore. The counter-balance chamber 82 is generally cylindrical and is disposed along the cylinder axis A. The internal diameter of the counter-balance chamber 82 is configured to mate with the nipple portion 70 of the adjustment plug 66 in a close-fitting sliding manner. An axial gas passage 84 extends between the counter-balance chamber 82 and the first end 76 of the balancing piston 74. The axial gas passage 84 may be formed with a tapered transition region that opens into the counter-balance chamber 82 like a funnel. At least one transverse gas passage 86 fluidly connects the gas collection groove 80 and the axial gas passage 84. In the illustrated embodiment, the at least one transverse passage 86 is actually a pair of orthogonally arranged radial through-holes. The first end 76 of the balancing piston 74 may be dished to form a bowl 88 in its crown. The axial gas passage 84 opens into the bowl 88.

A biasing member, generally indicated at 90, is operatively disposed between the adjustment plug 66 and the balancing piston 74. The biasing member 90 continuously urges the balancing piston 74 toward its gas transmitting position (FIGS. 2-4 and 6). In this embodiment, the biasing member 90 is disposed in the cylinder chamber 50, surrounding the nipple portion 70 of the adjustment plug 66. The biasing member 90, which may be implemented in the form of a Belleville washer stack, is configured to press directly against the second end 78 of the balancing piston 74.

Figure 2:
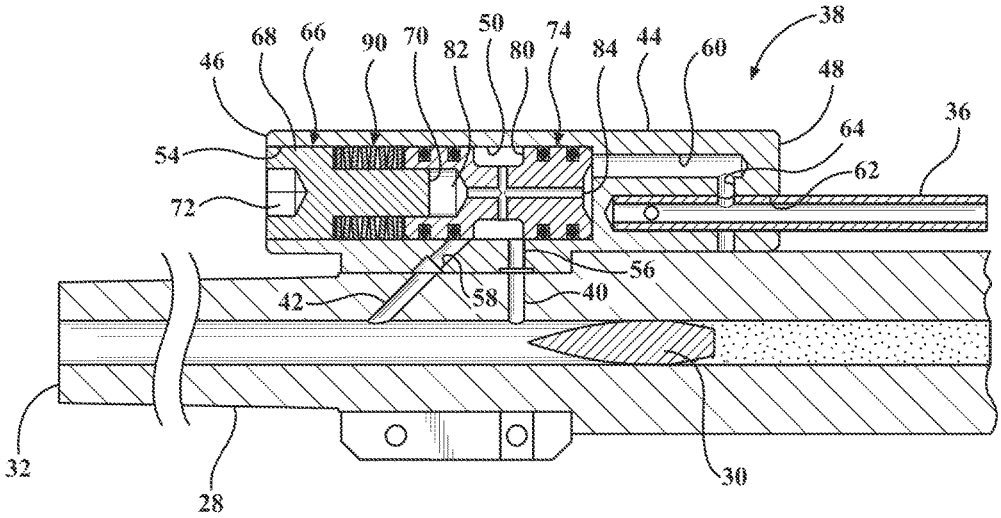
FIG. 2 is a fragmentary view the muzzle of a firearm barrel fitted with a gas block balancing assembly according to one embodiment of the present invention.

FIGS. 2-7 show different time periods of operation of the first exemplary embodiment of the balancing piston 74 in the gas block balancing assembly 38 as mounted on a select fire type (i.e., selectively semi-automatic or fully-automatic) firearm. During operation of the firearm, a projectile 30 is pushed down the bore of the barrel 28 with expanding gas pressure created by the burning of the gunpowder. In FIG. 2, the gas pressure (shown shaded in the figures) is pushing the projectile 30 down the firearm barrel 28 although no pressure has yet reached or entered the first gas port 40.

Figure 3:
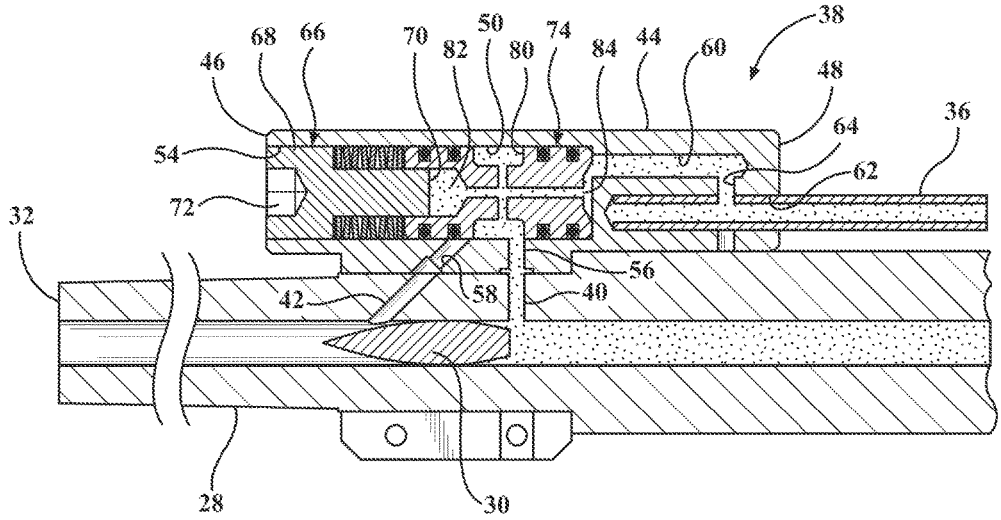
FIG. 3 is a view as in FIG. 2 showing a bullet advancing down the barrel with a trailing build-up of gas pressure that fills the gas block balancing assembly at a pressure below a predetermined maximum pressure threshold.

FIG. 3 illustrates the projectile 30 as it has passed the first gas port 40, enabling a portion of the high-pressure gas behind to pass into the mating inlet port 56 of the gas block balancing assembly 38. As perhaps more easily seen in the enlarged view of FIG. 6, the gas pressure then enters the cylinder chamber 50 via the gas collection groove 80. The expanding, high-pressure gas flows through the intersecting passages 84, 86 and thereby pass the full length of the balancing piston 74. That is to say, gas flows forward to fill the counter-balance chamber 82, and also flows rearward to fill the portion of the cylinder chamber at the first end 76 of the balancing piston 74. The rearward flowing gas continues to flow into the reserve chamber 60 passing through the transfer port 64 into the gas tube receptacle 62 and gas tube 36. The gas within the gas tube 36 continues to flow rearward into the firearm action to operate the firearm as described above.

FIG. 4 illustrates the projectile 30 as it has passed both gas ports 40, 42 just prior to exiting the muzzle 32 of the firearm barrel 28. As the maximum pressure of the gas flowing through gas ports 40, 42 and filling the gas block balancing assembly 38 remained lower than the adjusted maximum pressure of the system, the balancing piston 74 remains in the same rearward gas transmitting position as shown in the preceding two figures.

FIG. 5, however, illustrates the movement of the balancing piston 74 when the incoming gas pressure exceeds the maximum pressure limit adjusted by the adjustment plug 66 via the biasing member 90. Adjustment of the operating pressure of the system (i.e., the pressure which causes the balancing piston 74 to move forward sealing off the inlet port 56 and opening the outlet port 58 is accomplished by screwing in (to increase pressure) or screwing out (to decrease pressure) on the adjustment plug 66. By screwing in or backing out the adjustment plug 66, a corresponding increase or decrease the compressive force of the biasing member 90 is exerted in a rearward direction on the balancing piston 74.

Should the gas pressure created by the burning of the gunpowder within the firearm barrel 28, or back pressure created through the use of a sound suppressor, or any other factor that may create higher than "normal" pressures in the firearm barrel, cause the adjusted maximum operating pressure to exceed its set threshold, the balancing piston 74 will move forward, i.e., toward its bypass position. This forward movement of the balancing piston 74 obscures/seals off the inlet port 56 and opens the outlet port 58 thereby stopping incoming gas pressure and venting off the excess gas pressure back into the firearm barrel 28 through the outlet port 58/second gas port 42 pathway. Thus, any higher than desired pressures within the gas block balancing assembly 38 are vented into the relatively lower pressure area of the barrel bore. Barrel 28 bore pressure drops substantially as the projectile 30 approaches the muzzle 32 due to the bore volume change. Although in all likelihood the projectile 30 has exited the muzzle 32 prior to the venting sequence. Naturally, the timing of the venting sequences depends on the length of barrel 28 being used and where along the length of the barrel 28 the gas block balancing assembly 38 is located.

An advantage of the balancing piston 74 is that the pressures generated within the counter-balance chamber 82 act in concert with the biasing member 90. The greater the pressure entering the cylinder chamber 50, the more force assistance the counter-balance chamber 82 provides to the biasing member, thereby enabling a reduction in the size of the biasing member 90. As a result, a compact size biasing member 90 can be used to handle the relatively high pressures of gas operated firearms. Once gas enters the gas collection groove 80 of the balancing piston 74, and then flows through the transverse gas passages 86 and into the axial gas passage 84, the incoming gas is directed at equal pressure to both ends 76, 78 of the balancing piston 74. The first end 76 of the balancing piston 74 has a diameter substantially equal to that of the cylinder chamber 50. The second end 78 of the balancing piston 74, on the other hand, has the aforementioned counter-balance chamber 82 whose internal diameter is considerably smaller than the diameter of the first end 76 of the balancing piston 74. When comparing surface areas over which the high pressure gas acts, the first end 76 of the balancing piston 74 is larger than the internal diameter of the counter-balance chamber 82.

Gas pressure applied over the first end 76 of the balancing piston 74 creates a forward-acting (axial) force. Gas pressure applied to the balancing piston 74 from inside the counter-balance chamber 82 creates a rearward-acting (axial) force. Force equals Pressure times Area (Force=Pressure×Area). When comparing these counteracting forces, i.e., the opposing axial forces imposed on the balancing piston 74 due to the transient gas pressure from a fired projectile 30, the larger area of the first end 76, as compared with the smaller area of the counter-balance chamber 82, results in a larger forward acting force. In FIGS. 6 and 7, the counteracting axial forces arising from gas pressure are depicted as arrows. Larger and more wide-spread arrows (i.e., forces) pointing forward (toward the left) act on the first end 76 of the balancing piston 74. Smaller and more closely-spaced arrows point rearward (toward the right) and act on the balancing piston 74 inside its counter-balance chamber 82.

The net axial force result on the balancing piston 74 is a larger forward acting force due to the larger area at the first end 76 of the balancing piston 74. However, the rearward acting force created by the pressure acting on the balancing piston 74 within the counter-balance chamber 82 has the effect of reducing, or diminishing the forward acting force. This reduced or diminished forward acting force allows a smaller spring force for the biasing member 90 to be used to retard the forward movement of the balancing piston 74 when the incoming gas pressure exceeds a pre-set limit. The pre-set limit is adjusted by screwing in or out the adjustment plug 66. The combined axial force of the biasing member 90 and the rearward acting force created by the gas pressure multiplied by the area of the counter-balance chamber 82 counteracts the forward acting force of the gas pressure multiplied by the area of the first end 76 of the balancing piston 74. When the adjustment plug 66 is screwed in, the biasing member 90 is further pre-loaded against the balancing piston 74, thereby increasing the amount of forward-acting pressure needed to overcome the combined axial force of the biasing member 90 and the rearward acting force created by the gas pressure multiplied by the area of the counter-balance chamber 82. Conversely, when the adjustment plug 66 is screwed out of the cylinder chamber 50, the pre-load on the balancing piston 74 is diminished, thereby decreasing the amount of forward-acting pressure needed to overcome the combined axial force of the biasing member 90 and the rearward acting force created by the gas pressure multiplied by the area of the counter-balance chamber 82.

When the incoming gas pressure exceeds the maximum pressure limit as set by the adjustment plug 66, as shown in FIGS. 5 and 7, it is informative to note that the gas collection groove 80 in the middle of the balancing piston 74 provides a beneficial volume of gas storage, as does the reservoir chamber 60. When a fired projectile 30 passes the first gas port 40, system gasses fill the gas collection groove 80 of the balancing piston 74 as well as the reservoir chamber 60 with gas pressure up to the pre-set threshold. As soon as the balancing piston 74 shifts forward under gas pressures above the pre-set threshold, the stored gasses in the gas collection groove 80 and the reservoir chamber 60 are free to exhaust back into the barrel 28 via the outlet port 58/second gas port 42. (By this time, the barrel 28 pressure has dropped dramatically by movement of the projectile 30 much farther down the barrel 28 and more likely having exited the muzzle 32. As an added design feature, forward movement of the balancing piston 74 has the effect of pushing the stored gases with a forward vector so that they vent back into the firearm barrel 28 with forward momentum. The forward slant or angle of the outlet port 58/second gas port 42 thus contributes to the fluid efficiency of pushing gasses toward the muzzle 32. This forward momentum venting reduces the burned and fouled gunpowder gasses from flowing rearward back into the firearm action thereby keeping the firearm action cleaner and away from the shooters face.

Figure 8:
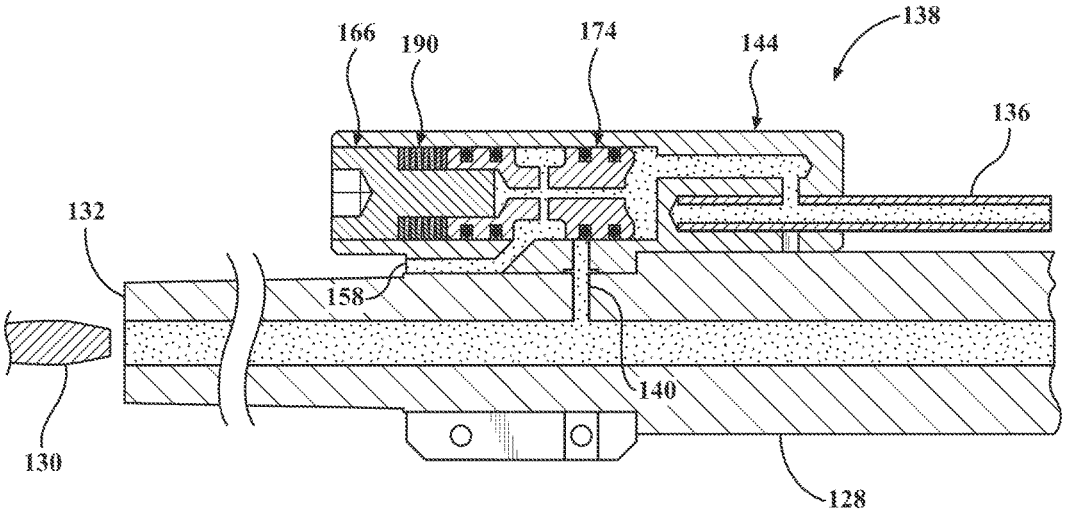
FIG. 8 depicts a first alternative embodiment of the gas block balancing assembly where vented gas pressure is expelled external to the barrel.

FIG. 8 depicts a first alternative embodiment of the present invention wherein like or similar parts are described with established reference numbers that have been offset by 100. For example, the housing of FIG. 8 is 144, the adjustment plug is 166, the balancing piston is 174, and so forth. In this view, which is similar in most respects to FIG. 5, the second gas port 142 is reconfigured to vent to atmosphere rather than back into the barrel 128. The second gas port 142 here takes the form of a semi-circular vent created by a counter-bore or slot cut in the housing 144 of the gas block balancing assembly 138. The semi-circular vent surrounds the outer surface of the barrel 128 and opens toward the muzzle 132.

Should the gas pressure created by the burning of the gunpowder within the firearm barrel 128, back pressure created through the use of a sound suppressor, or any other factor that may create higher than desired pressures exceed the adjusted maximum operating pressure, the balancing piston 174 will move forward. This forward movement of the balancing piston 174 obscures/seals off the inlet port 156 and opens the outlet port 158, thereby stopping incoming gas pressure and venting off the excess gas pressure into the atmosphere through the second gas port 142. Those of skill in the art will envision alternative configurations for the shape and location of the second gas port 142, which may include routed discharge into an associated suppressor device (not shown).

Figure 13:
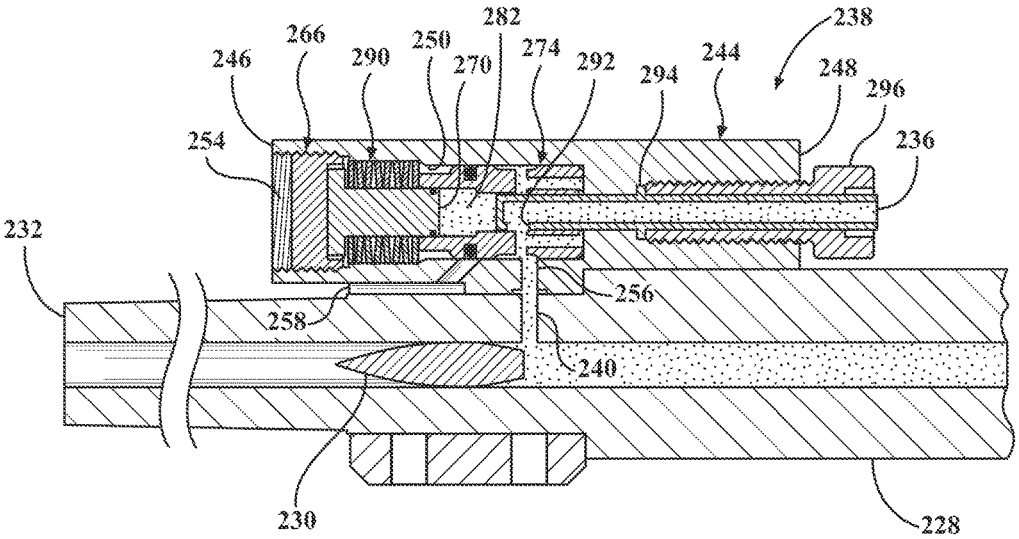
FIG. 13 is a view as in FIG. 12 showing a bullet advancing down the barrel with a trailing build-up of gas pressure that fills the gas block balancing assembly at a pressure below a predetermined maximum pressure threshold.
Figure 14:
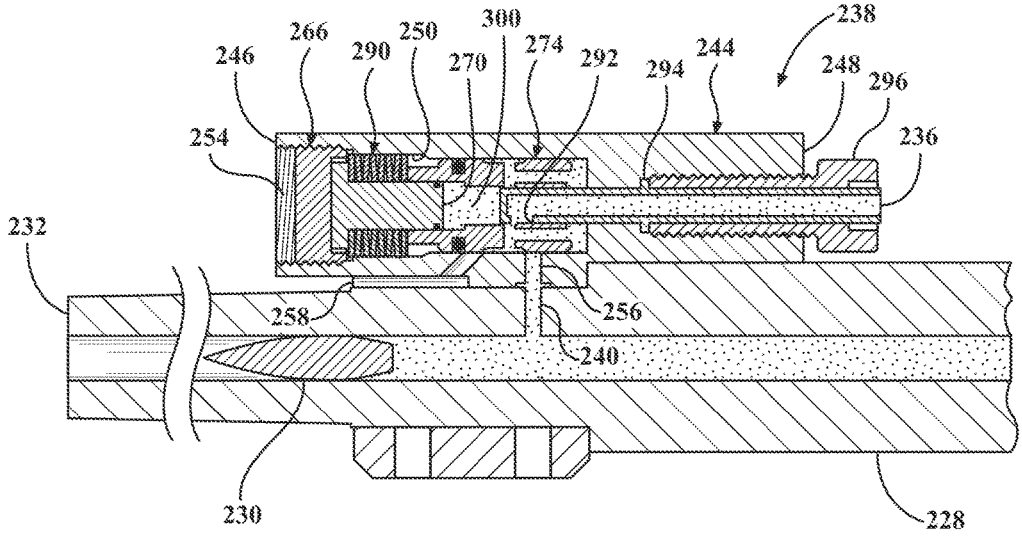
FIG. 14 is a view as in FIG. 13 showing the bullet further advanced along the barrel, and where the trailing build-up of gas pressure exceeds the predetermined maximum pressure threshold so that the balancing piston begins to shift rearward (to the right as viewed)
Figure 15:
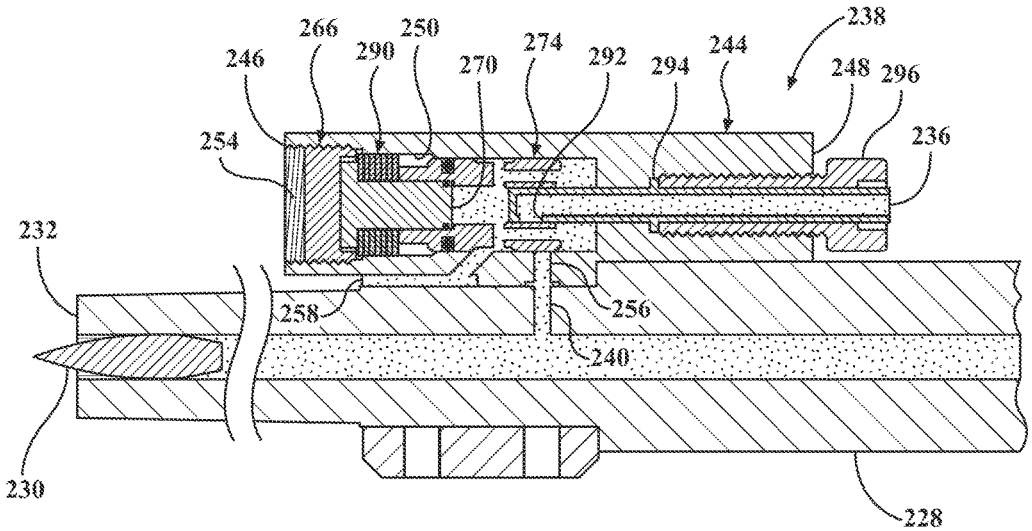
FIG. 15 is a view as in FIG. 14 showing the bullet still further advanced along the barrel, and the balancing piston shifted to is full rearward position (to the right as viewed)
Figure 16:
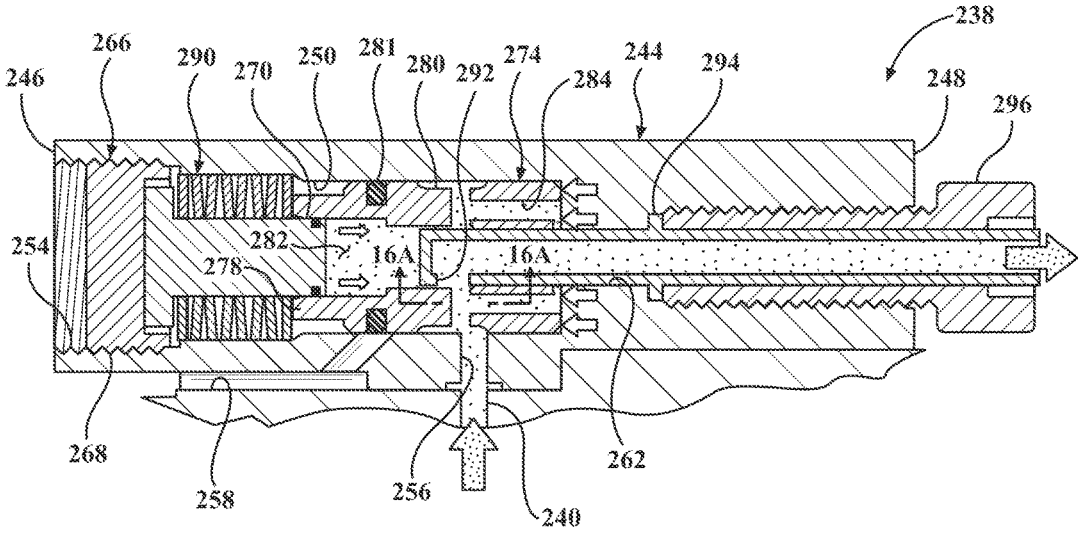
FIG. 16 is an enlarged view of the second alternative gas block balancing assembly in situations where the gas pressure is below the predetermined maximum pressure threshold as in FIG. 13.
Figure 17:
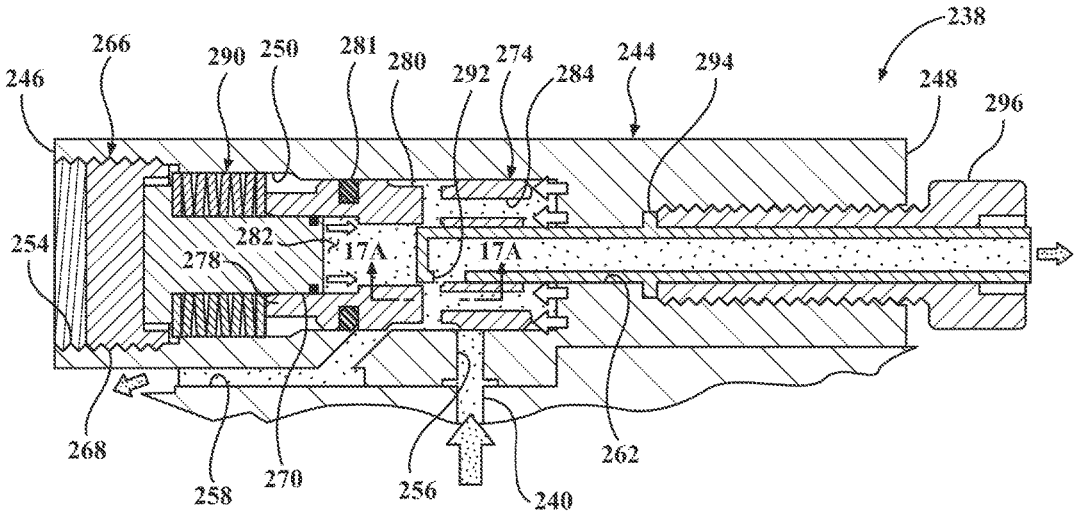
FIG. 17 is an enlarged view of the gas block balancing assembly as in FIG. 14 where the gas pressure exceeds the predetermined maximum pressure threshold and the balancing piston has partially shifted toward its rearward position.
Figure 18:
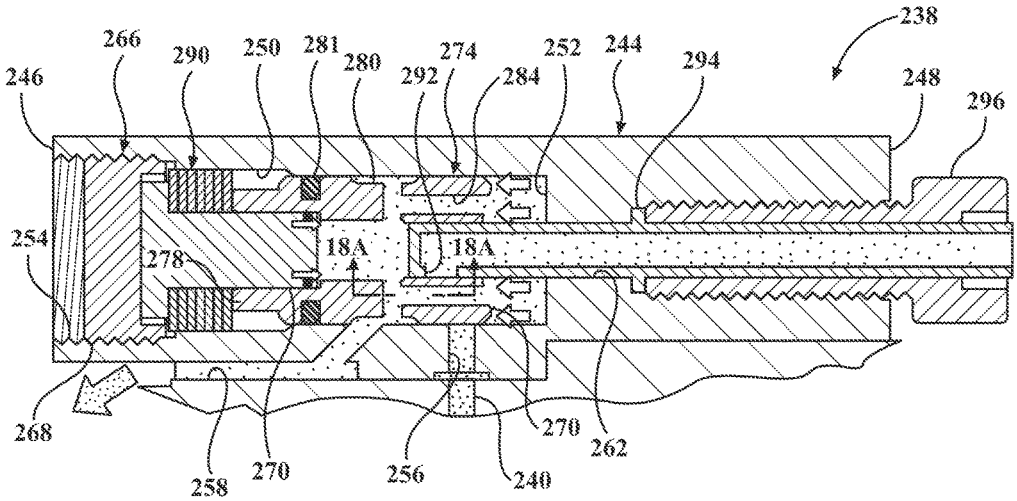
FIG. 18 is an enlarged view of the gas block balancing assembly as in FIG. 15 where the gas pressure exceeds the predetermined maximum pressure threshold and the balancing piston has fully shifted toward its rearward position.

Turning now to FIGS. 9-18A, a second alternative embodiment of the present invention is shown. In this example, like or similar parts are described with established reference numbers that have been offset by 200. For example, the housing of FIGS. 9-18A is 244, the adjustment plug is 266, the balancing piston is 274, and so forth. A primary distinction between the second alternative embodiment and both preceding embodiments is that as the balancing piston 274 moves from its gas transmitting position, as shown in FIGS. 12-14 and 16, there is a variable transition (FIG. 17) to the bypass position (FIGS. 15 and 18). In the provided example, this transition is accomplished via an orifice 292 in the gas tube 236 so as pressure inside the cylinder chamber 250 increases the effective size of the orifice 292 decreases.

Figure 9:
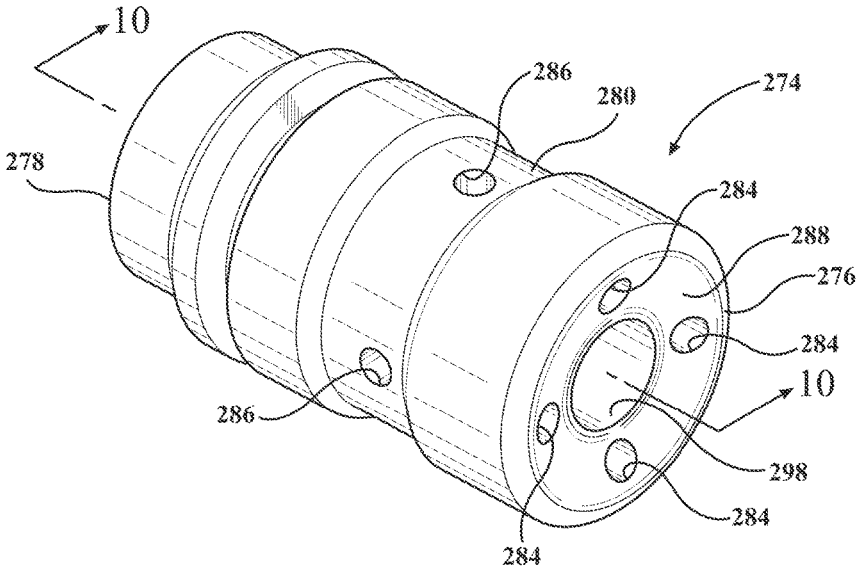
FIG. 9 is a perspective view of a balancing piston according to a second alternative embodiment of the gas block balancing assembly.
Figure 10:
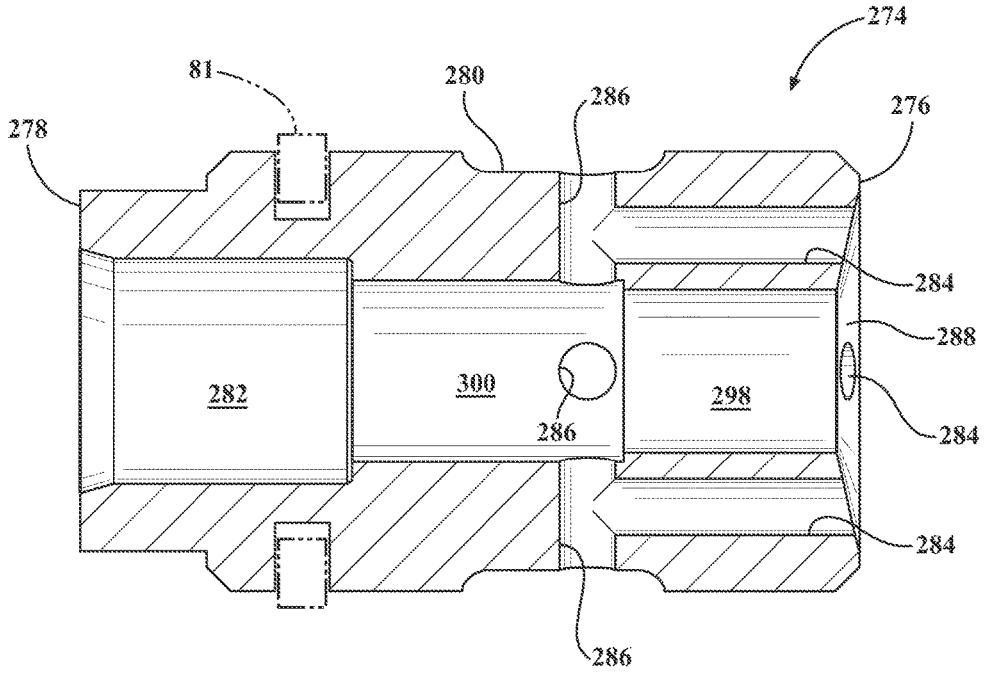
FIG. 10 is a cross-sectional view of the balancing piston as taken generally along lines 10-10 in FIG. 9.
Figure 11:
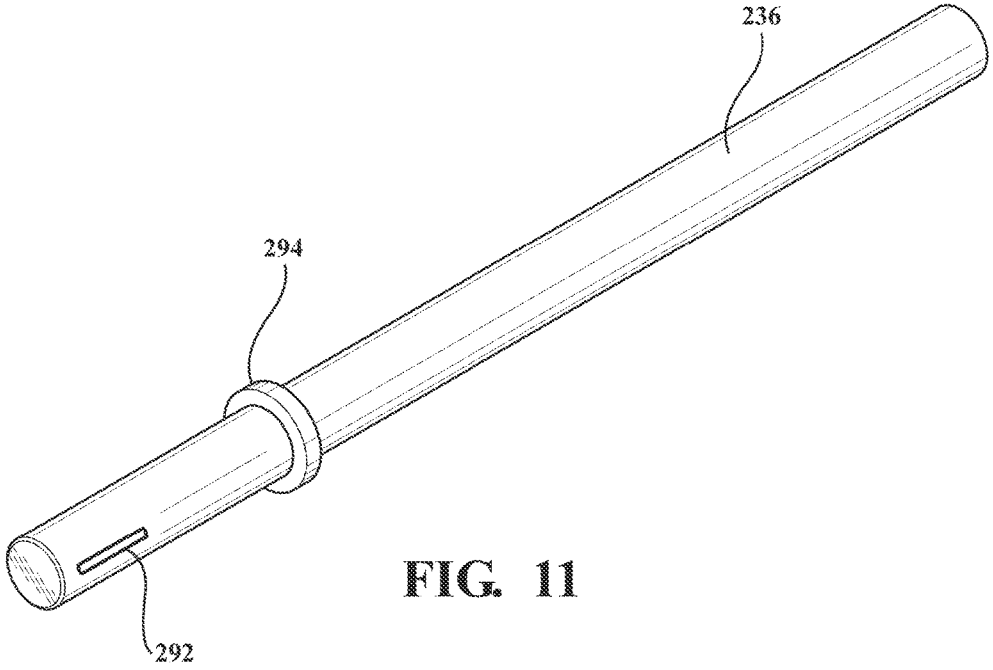
FIG. 11 is a perspective view of the gas tube feature of the second alternative embodiment of the gas block balancing assembly.

The modified balancing piston 274 of the second alternative embodiment is shown in FIGS. 9 and 10. Notably, the gas tube 236 is routed directly into the cylinder chamber 250 along the cylinder axis A. The tip or terminal end of the gas tube 236 is closed or capped, and a flange 294 is formed about its shaft nearby. The flange 294 compresses, with the aid of a fitting 296, against a shoulder inside the housing 244 to establish a gas tight seal. As shown in FIG. 11, the above-mentioned orifice 292 is disposed between the terminal end and the flange 294 of the gas tube 236. The orifice 292 is shown in the figures as an oval slot, however other configurations are possible. For example, the orifice 292 could be formed by a series of holes or by any suitable regular or irregular shape. The shaft of the gas tube 236 in the region of the orifice 292 has a generally consistent diameter which will be referred to as the tube tip diameter.

A cross-section through the balancing piston 274 is provided in FIG. 10. Extending axially from the first end 276 of the balancing piston 274 is a tube bore 298. The internal diameter of the tube bore 298 is dimensioned to receive the shaft of the gas tube 236 in the region of the orifice 292 with a close but smooth running clearance. That is to say, the tube bore 298 has an internal diameter that is slightly larger than the tube tip diameter so as to establish a comfortable sliding fit. The axial length of the tube bore 298 is designed relative to the axial position of the orifice 292 so that when the balancing piston 274 is in its gas transmitting position (FIGS. 12-14 and 16), the orifice 292 is completely extended beyond the tube bore 298 and into the interior body of the balancing piston 274. However, when the balancing piston 274 is in its bypass position (FIGS. 15 and 18), the orifice 292 is completely contained within the confines of the tube bore 298. Because of the close tolerance spacing between the tube bore 298 and the tube tip diameter, the orifice 292 becomes effectively sealed off when the balancing piston 274 is in its bypass position.

A central gas channel 300 extends between the tube bore 298 and the counter-balance chamber 282. The diameter of the central gas channel 300 is larger than the diameter of the tube bore 298, but smaller than the diameter of the counter-balance chamber 282. Because the central gas channel 300 is sufficiently larger than in diameter than the tube bore 298, pressurized gas will freely flow into the gas tube 236 when the balancing piston 274 is in its gas transmitting position (FIGS. 12-14 and 16), i.e., when the orifice 292 protrudes into the central gas channel 300.

Figure 12:
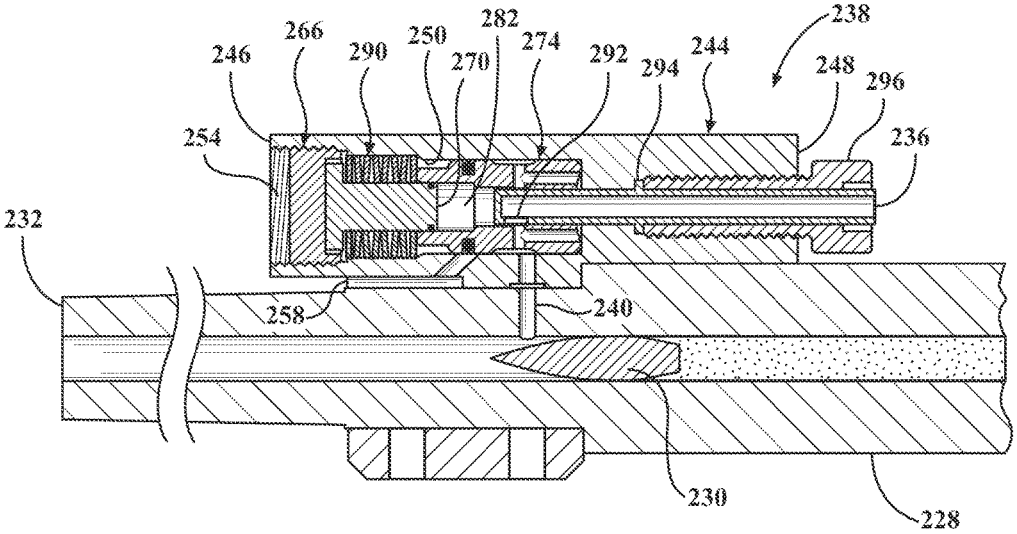
FIG. 12 is a fragmentary view the muzzle of a firearm barrel fitted with the second alternative embodiment of the gas block balancing assembly.

FIGS. 12-14 correspond to FIGS. 2-4 in that the projectile 30 is shown in a progression of flight relative to the first gas port 240, and at all times the maximum pressure of the gas in the barrel 228 remains lower than the adjusted maximum pressure of the system 238. That is, the balancing piston 274 remains in the same rearward gas transmitting position throughout the entire discharge of the projectile 230. If the pressure is below the set pressure then the force (Force=Pressure×Area) generated by the gas pressure acting on the first end 276 of the balancing piston 274 will be less than the gas pressure acting on the balancing piston 274 in the counter-balance chamber 282 plus the spring force of the biasing member 290 and the balancing piston 274 will not be motivated to shift from its gas transmitting position.

The gas path in this scenario is from the barrel 228 through the first gas port 240, into the inlet port 256, into the gas collection groove 280, around balancing piston 274, through the transverse gas passages 286, into the that axial gas passages 284 (four shown in this example) and out the first end 276 to fill the rearward end of the cylinder chamber 250. The gas simultaneously flows through the transverse gas passages 286 into the tube bore 298 and forwardly to fill the counter-balance chamber 250. Gas also flows around the tip of the gas tube 236 and into the orifice 292 where it flows back to the receiver (not shown) for cycling the action. So long as the gas pressure remains below the set pressure (via the adjustment plug 266), the combined force of the biasing member 290 and from the pressure in the counter-balance chamber 250 will overbear the force from the pressure at the first end 276 of the balancing piston 274, thus restraining the balancing piston 274 in the gas transmitting position as show.

However, if the pressure of the system exceeds the set pressure, then the balancing piston 274 will move forward due to the greater force generated on its first end 276. FIG. 15, which corresponds to FIG. 5, depict the scenario where incoming gas pressure exceeds the maximum pressure limit adjusted by the adjustment plug 266 via the biasing member 290.

FIGS. 16-18 are enlarged views of the gas block balancing assembly 238 according to the second alternative embodiment. In these figures, the counteracting axial forces arising from gas pressure are depicted as arrows. Larger and more wide-spread arrows pointing forward (toward the left in this view) act on the first end 276 of the balancing piston 274. Smaller and more closely-spaced arrows point rearward (toward the right in this view) and act on the balancing piston 274 inside its counter-balance chamber 282.

Figure 16A:
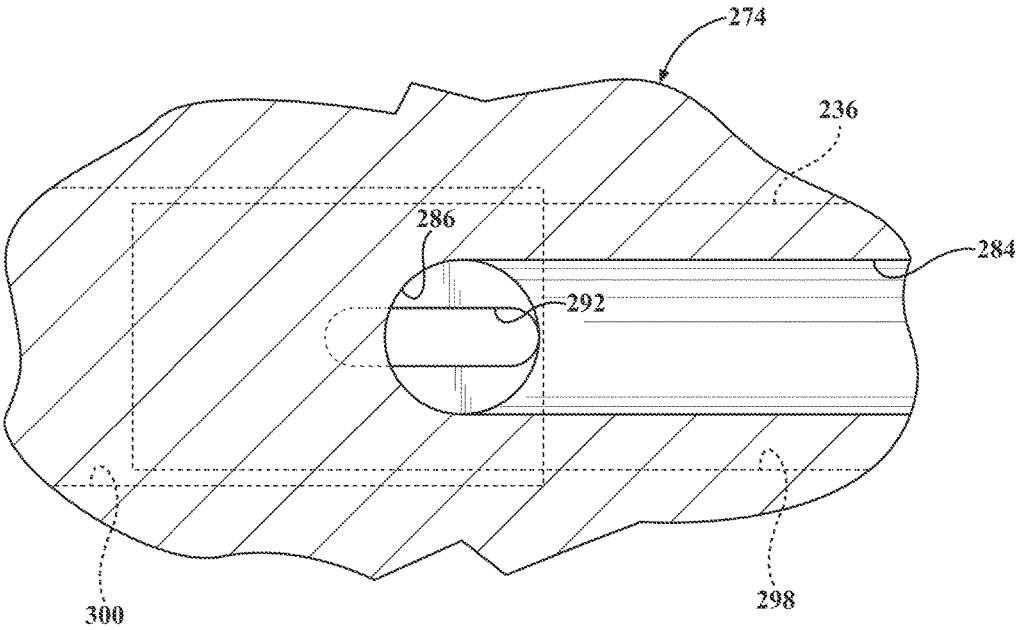
FIG. 16A is a fragmentary cross-sectional view taken generally along lines 16A-16A of FIG. 16 to illustrate the full exposure of the inlet orifice on the tip of the gas tube when the gas pressure is below the predetermined maximum pressure threshold.
Figure 17A:
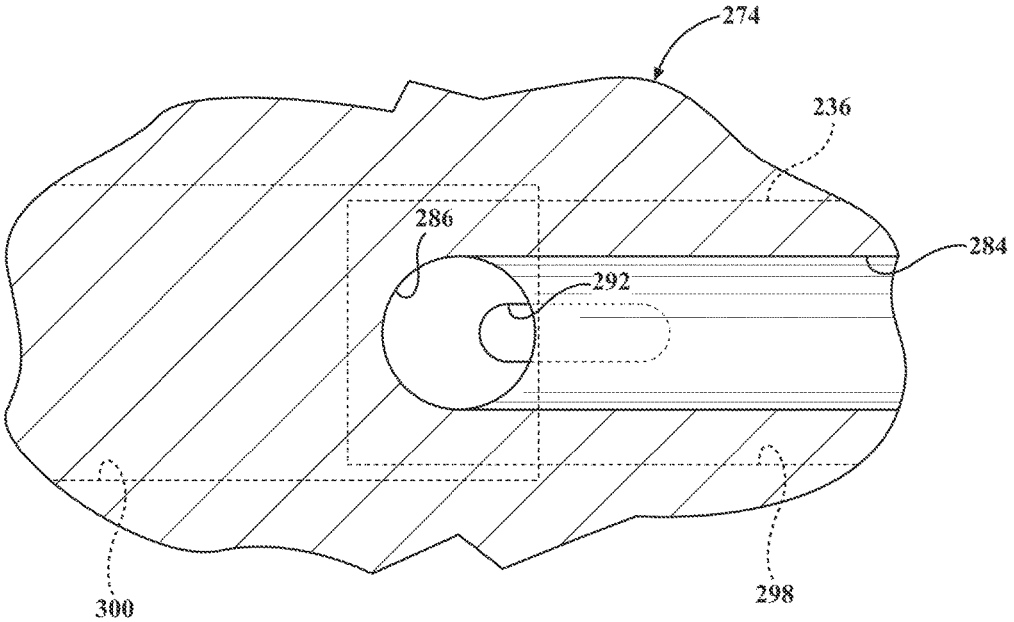
FIG. 17A is a fragmentary cross-sectional view taken generally along lines 17A-17A of FIG. 17 to illustrate the partial exposure of the inlet orifice on the tip of the gas tube when the balancing piston has partially shifted toward its rearward position.
Figure 18A:
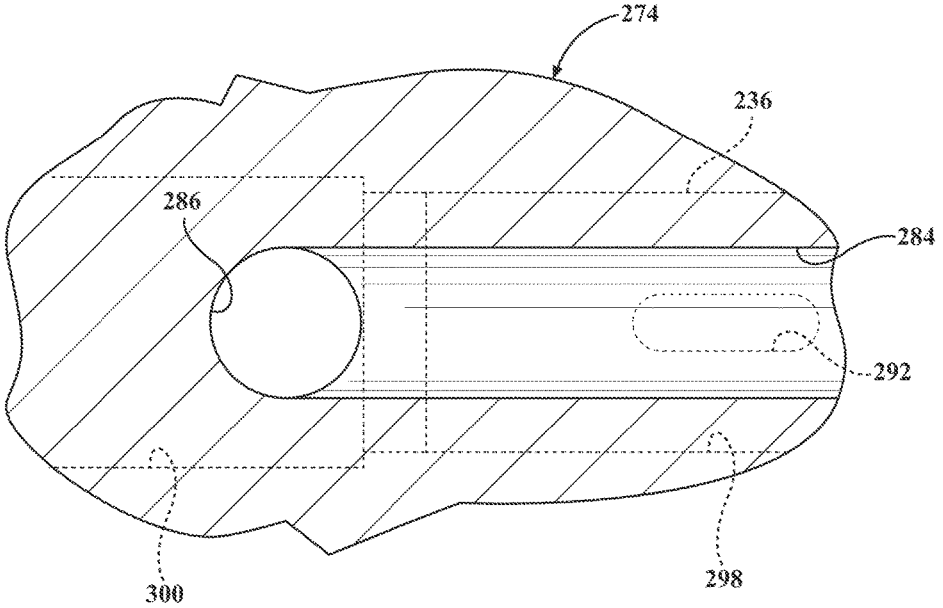
FIG. 18A is a fragmentary cross-sectional view taken generally along lines 18A-18A of FIG. 18 to illustrate the complete isolation of the inlet orifice on the tip of the gas tube when the balancing piston has fully shifted toward its rearward position.

In FIG. 16, the balancing piston 274 is shown in the gas transmitting position. In FIG. 18, the balancing piston 274 is shown in the bypass position. FIG. 17 shows an intermediate condition between the gas transmitting and bypass positions. That is to say, the second alternative embodiment is distinguished by enabling a transition between the gas transmitting position of FIG. 16 and the bypass position of FIG. 18 wherein a reduced but discernable flow of pressurized gas is permitted into the gas tube 236 through the orifice 292. The transition is accomplished by the ability of the close-fitting tube bore 298 to choke off gas flow around the tube tip. FIGS. 16A, 17A and 18A are provided to better illustrate this phenomenon. As the balancing piston 274 begins to move away from the gas transmitting position under the influence of higher than desired gas pressures in the barrel 228, the orifice 291 will begin to be partially eclipsed within the tube bore 298. This has the effect of increasing flow restrictions as the orifice size decreases and also increases the volume of the counter-balance chamber 250, which in turn reduce the flow rate of gas into the gas tube 236. A feathering of pressure cessation will occur at the firearm action, rather than an abrupt termination as the balancing position moves fully into the bypass position. The feathering phenomenon may further help reduce vibrations transmitted into the firearm barrel 228.

In FIGS. 4 and 5 another option for the positioning of the piston can be envisioned where, when the gas pressure is below the set pressure, the piston remains in the gas transmitting position as shown in FIG. 4. When the gas pressure exceeds the set pressure, the piston moves to the bypass position as shown in FIG. 5. A third position of the counter-balance piston can be envisioned where a section of the biasing member is composed of a stronger series of Belleville spring washers that collapse at a higher force generated at the rearward end of the counter balance piston 76. In this third position of the counter-balance piston, which will most likely only be reached during sustained fire in the full automatic fire mode of the firearm, the piston will allow venting directly to an external high flow suppressor or to atmosphere through a third and separate port.

The foregoing invention has been described in accordance with the relevant legal standards, thus the description is exemplary rather than limiting in nature. Variations and modifications to the disclosed embodiment may become apparent to those skilled in the art and fall within the scope of the invention. For example, the principles of the gas block balancing assembly 38, 238 could be applied to a piston-rod style activation system rather than a gas impingement type system with minimal reconfiguration. Other adaptions are likewise possible and contemplated to the extent they would find literal response in the following claims.

What is claimed is:

1. A gas block balancing assembly for an auto-loading firearm, said assembly comprising:

a housing having forward and rearward ends, said housing configured for attachment to a rifle barrel having a first gas port, a cylinder chamber disposed within said housing, said housing including an inlet port extending from said cylinder chamber and disposed to receive pressurized gas from the first gas port of the barrel, said housing including an outlet port extending from said cylinder chamber, a gas tube receptacle disposed in said housing, said gas tube receptacle configured to couple with a gas tube conduit, an adjustment plug disposed in said cylinder chamber, said adjustment plug having a nipple portion extending into said cylinder chamber generally along said cylinder axis, a balancing piston disposed in said cylinder chamber for axial sliding movement between a gas transmitting position and a bypass position, said balancing piston having a first end disposed adjacent said end wall of said cylinder and an opposite second end disposed adjacent said adjustment plug, a biasing member operatively disposed between said adjustment plug and said balancing piston for urging said balancing piston toward said gas transmitting position, and a counter-balance chamber extending into said second end of said balancing piston, said counter-balance chamber comprising a generally cylindrical bore disposed generally along said cylinder axis, said counter-balance chamber having an internal diameter configured to mate with said nipple of said adjustment plug in close-fitting sliding engagement.

2. The assembly of claim 1, wherein said cylinder chamber extends from an open end in said forward end of said housing to an end wall adjacent said rearward end of said housing, said cylinder chamber including female thread forms adjacent said open end thereof, said adjustment plug closing said open end of said cylinder chamber, said adjustment plug having a fixture portion, said fixture portion comprising external thread forms adapted to engage said female thread forms in said open end of said cylinder chamber.

3. The assembly of claim 2, further including a reservoir chamber disposed in said housing, said reservoir chamber disposed in fluid communication with said end wall of said cylinder chamber, and a transfer port fluidly connects said reservoir chamber and said gas tube receptable.

4. The assembly of claim 1, wherein said balancing piston includes an external gas collection groove, said gas collection groove comprising a generally annular exterior formation, said gas collection groove disposed in fluid communication with said inlet port of said housing when said balancing piston is in said gas transmitting position, and said gas collection groove disposed in fluid communication with said outlet port of said housing when said balancing piston is in said bypass position.

5. The assembly of claim 4, further including an axial gas passage extending between said counter-balance chamber and said first end of said balancing piston, at least one transverse gas passage fluidly connecting said gas collection groove and said axial gas passage.

6. The assembly of claim 1, wherein said biasing member surrounds said nipple and is configured to press against said second end of said balancing piston.

7. The assembly of claim 6, wherein said biasing member comprises a Belleville washer stack.

8. The assembly of claim 1, further including a gas tube having a closed terminal end, said terminal end being cylindrical and having a tube tip diameter, an orifice disposed in said gas tube adjacent said terminal end, said first end of said balancing piston including a tube bore dimensioned to receive said terminal end of said gas tube with a sliding clearance fit.

9. The assembly of claim 8, wherein said balancing piston further includes a central gas channel extending between said tube bore and said counter-balance chamber, said central gas channel having an internal diameter larger than said tube bore and smaller than said counter-balance chamber.

10. The assembly of claim 9, wherein said balancing piston includes an external gas collection groove, said gas collection groove comprising a generally annular exterior formation, said gas collection groove disposed in fluid communication with said inlet port of said housing when said balancing piston is in said gas transmitting position, and said gas collection groove disposed in fluid communication with said outlet port of said housing when said balancing piston is in said bypass position, at least one transverse gas passage fluidly connecting said gas collection groove and said central gas channel, at least one axial gas passage extending between said at least one transverse gas passage and said first end of said balancing piston.

11. The assembly of claim 1, wherein said outlet port comprises a semi-circular vent to atmosphere.

* * * * *